United States Patent [19]

Johnston

[11] 4,072,488

[45] Feb. 7, 1978

[54] AIR DEFROST REACH-IN REFRIGERATED DISPLAY CABINET

[75] Inventor: William C. Johnston, Atlanta, Ga.

[73] Assignee: Kysor Industrial Corporation, Cadillac, Mich.

[21] Appl. No.: 749,346

[22] Filed: Dec. 10, 1976

[51] Int. Cl.[2] ..... F25D 21/10

[52] U.S. Cl. ..... 62/282

[58] Field of Search ..... 62/150, 151, 282, 82

[56] References Cited

U.S. PATENT DOCUMENTS

| | | | |
|---|---|---|---|
| 2,525,868 | 10/1950 | Corhanidis | 62/282 |
| 3,115,017 | 12/1963 | Kocher et al. | 62/282 |
| 3,850,003 | 11/1974 | Beckwith et al. | 62/82 |
| 3,937,033 | 2/1976 | Beckwith et al. | 62/282 |

*Primary Examiner*—Lloyd L. King

*Attorney, Agent, or Firm*—Price, Heneveld, Huizenga & Cooper

[57] ABSTRACT

An air defrost reach-in refrigerated display case employing aerodynamic isolation of the coil from the product storage and display space during defrost. The fans and refrigeration coil are in a chamber separated from the display space, there being restricted flow flues between this chamber and the display space. Ambient air inlet and discharge ports astraddle the coil and fans, and between the cabinet exterior and this chamber enables short circuit flow of ambient defrosting air through the ports for defrosting of the coil when doors on the ports are open, without significant flow into the storage and display space.

5 Claims, 4 Drawing Figures

AIR DEFROST REACH-IN REFRIGERATED DISPLAY CABINET

BACKGROUND OF THE INVENTION

This invention relates to a refrigerated display cabinet having air defrost capacity, and more particularly to such a cabinet having areodynamic isolation of the refrigeration coil from the product storage and display space during air defrost of the coil.

The high cost of energy in recent years has prompted efforts to develop commercial refrigerated display cases not requiring added energy, e.g. electrical or heated gas, for periodic defrosting of the coil. These efforts, largely applied to display cases of the open front, multiple curtain type, have resulted in cabinets which are defrosted by flow of ambient air through the cabinet duct system that extends around the product zone, generally separated therefrom.

When a "reach-in" type of display cabinet, however, i.e. one having physical access doors, usually of glass, on the front, the refrigerated air is circulated from the coil directly through the product storage and display space and back to the coil during normal operation. However, during defrost, it is not desirable to circulate warm defrosting air through this storage product because of warming and/or melting of the product and frost formation on the product surfaces. Therefore, it would be desirable to air defrost such display cases without significant flow of warm defrost air through the product space. One conceivable technique would be to keep the warmer air out of the product space by dampers or doors in the ducts. However, such devices have a tendency to freeze shut or open to cause maintenance problems in portions of the case not readily accessible.

SUMMARY OF THE INVENTION

This present invention constitutes a reach-in type of refrigerated display case capable of achieving air defrost economies in a dependable fashion without significant flow of the defrost air in the product space, by aerodynamic isolation of the product space from the coil during defrost. The coil is in a chamber separated from the display space while communicant therewith by flues through which the refrigerated air is propelled from the coil to the display space and then returned to the coil in recirculatory pattern. Also communicant with the chamber, astraddle of the coil and the adjacent air propelling means, e.g. fans, are ambient air entry and discharge ports which have doors for opening and closing thereof. The size and location of these ports relative to the flue arrangement to the storage space are such that, when these ports are opened, the resistance to flow of air through the recirculation flues from the chamber to the display space is significantly greater than through these ports, such that only insignificant flow occurs through the flues, the flow rather being through these ports under the influence of the air propelling fans, thereby aerodynamically isolating the product display space from the coil being defrosted.

The invention acheives effective rapid defrost of the coil without dampers in the flues, and yet without damage to the products. A significant advantage is the relative simplicity of the structure and also the operation thereof, yet achieving marked savings in energy usage.

These and several other objects of this invention will become apparent upon a study of the following detailed description in conjunction with the drawings.

DESCRIPTION OF THE PREFERRED EMBODIMENT

Figure 2:
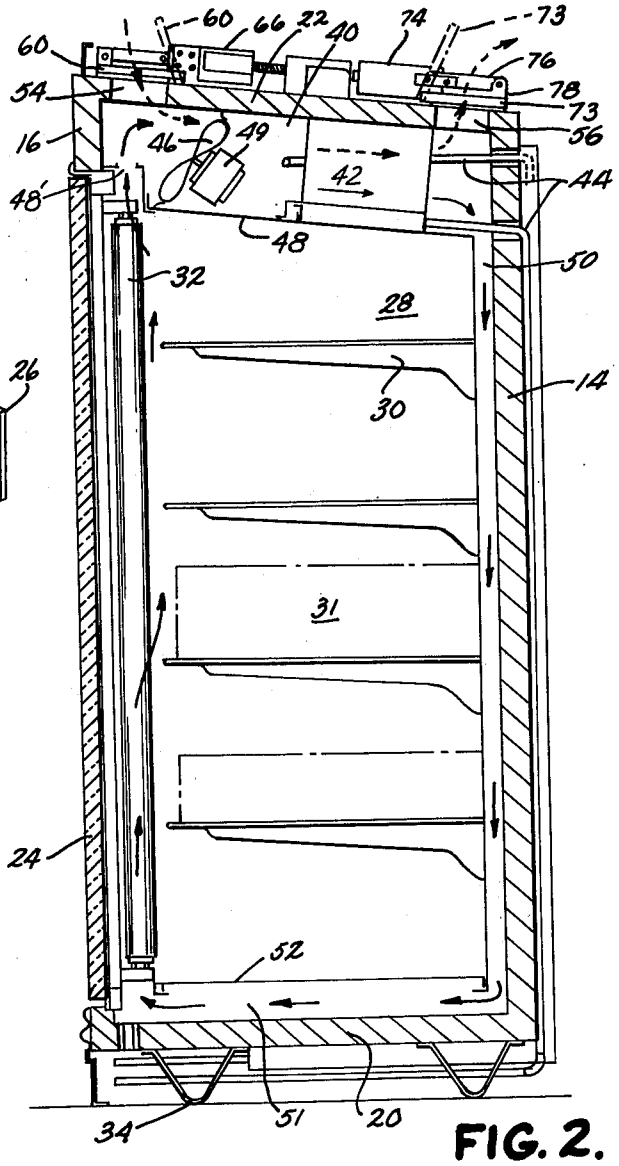
FIG. 2 is a side elevational sectional view of the cabinet in FIG. 1.
Figure 1:
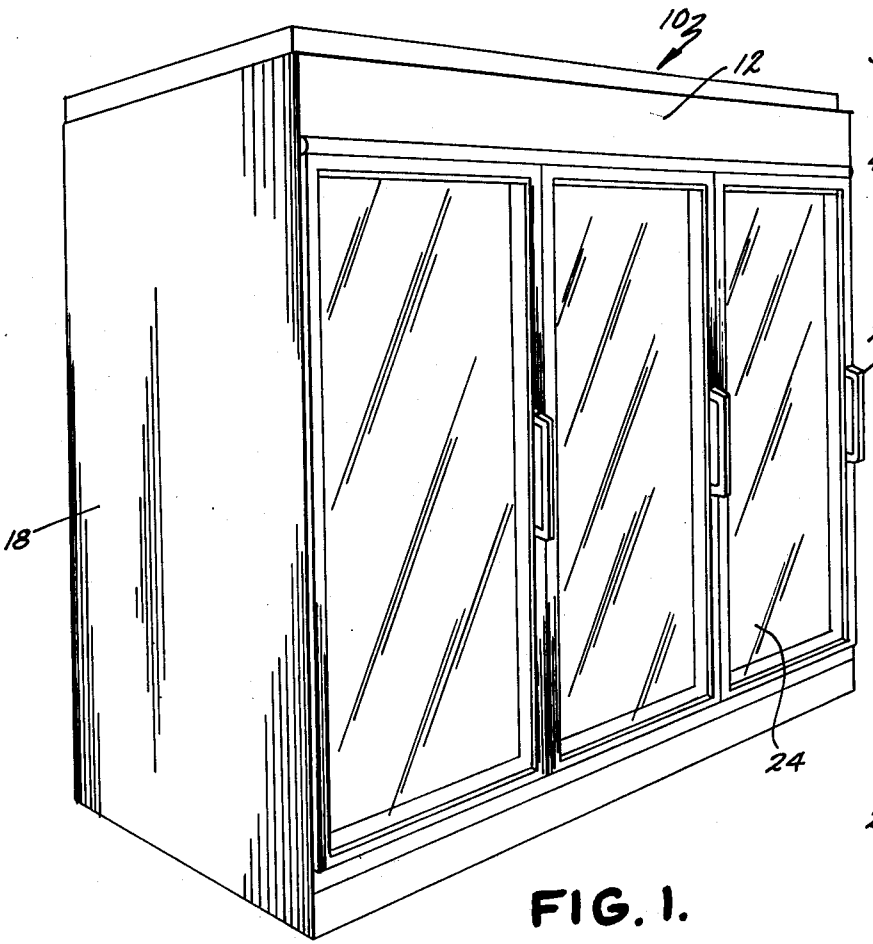
FIG. 1 is a perspective view of a reach-in cabinet of this invention.
Figure 3:
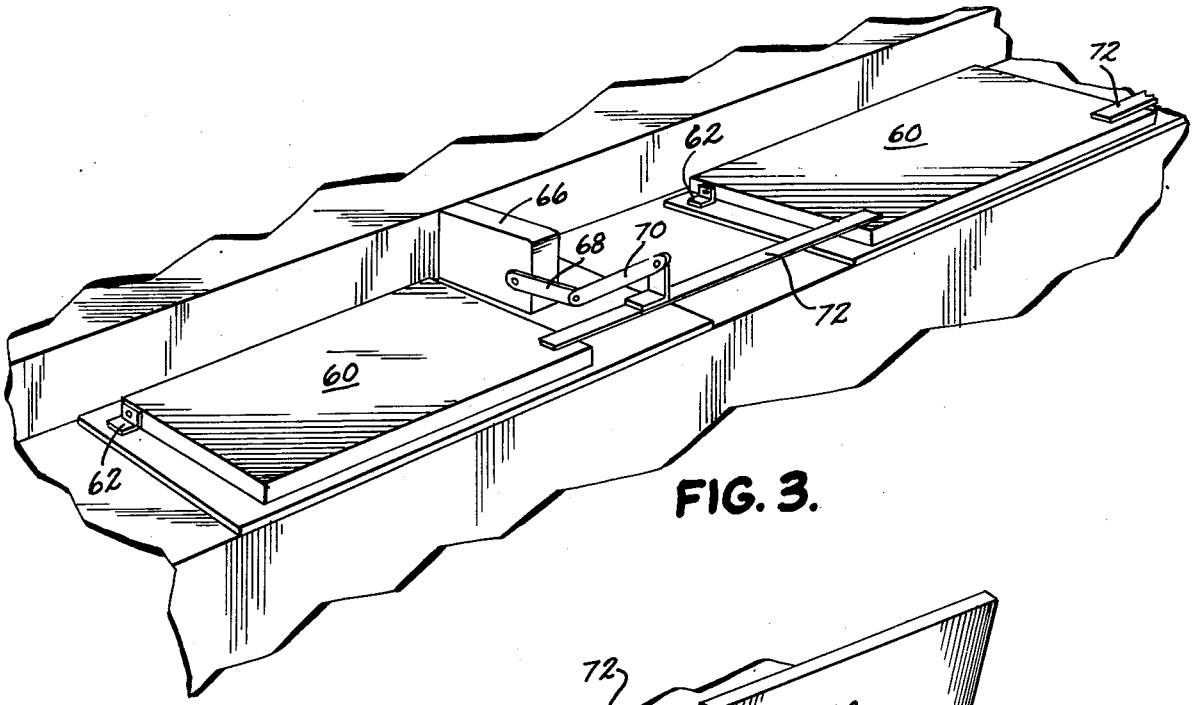
FIG. 3 is a fragmentary enlarged perspective view of a top portion of the apparatus in FIGS. 1 and 2, showing doors in a closed position over the defrost air entry ports.
Figure 4:
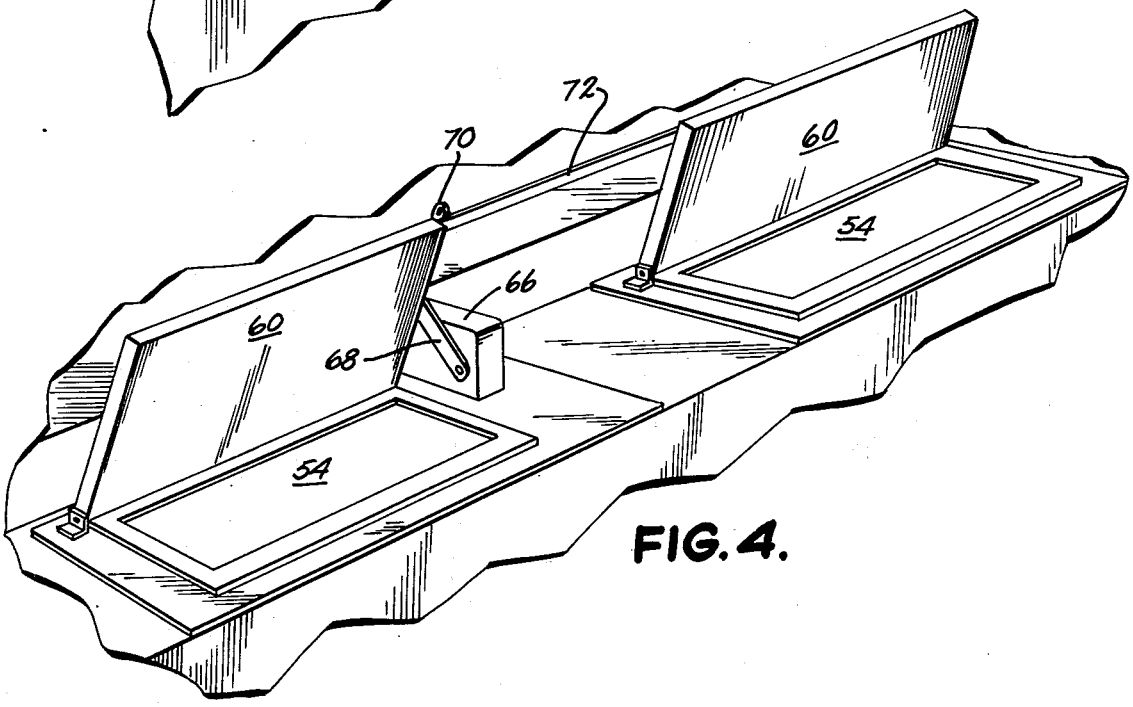
FIG. 4 is a fragmentary enlarged perspective view of the apparatus in FIG. 3 showing the doors in an elevated position to open the ports.

Referring now specifically to the drawings, the reach-in display case 10 there depicted includes an enclosure cabinet having a back 14, front 16, ends 18, bottom 20, and top 22. The front includes a plurality of hinged access doors 24, usually glass, employing suitable handles 26 to allow customer access to the enclosed product display space 28. Space 28 typically includes a plurality of vertically spaced shelves 30 for support of product 31. Fluorescent lights 32 are provided to illuminate the product storage and display space. The cabinet may be supported on suitable feet or pedestals 34.

In the top of the cabinet is a chamber 40 which contains a cooling coil of a conventional refrigeration system (not shown) that normally includes a compressor and an expansion valve connected with coil 42 with refrigeration lines 44. Air flowing through the coil is cooled for maintaining product at the desired temperature. Mounted in chamber 40, adjacent to and upstream of coil 42, is air propelling means typically in the form of a plurality of fans 46 driven by motors 49. Chamber 40 is separated from product storage and display space 28 therebelow by a generally horizontal panel 48 which is preferably thermally insulated.

Coil 42 is intermediate the front and back of the cabinet in chamber 40. On opposite faces of coil 42, front and back, are flues through which chamber 40 is in communication with display space 28. More specifically, in front of coil 42 and adjacent fans 46 is a return flue 48' to allow return air to be drawn up by fans 46 from display space 28 and propelled through coil 42 from front to rear. Cold air from the rear of coil 42 goes through restricted vertical duct 50 at the back of the cabinet, extending downwardly behind the display space, into bottom horizontal flue 51, which is formed by product pans 52 and bottom 20. The air then flows vertically up across doors 24, between these doors and the front edges of shelves 30, the usual product 31 on shelves 30 cooperating with the doors to form an irregularly shaped vertical flue which ends at opening 48' upstream of fans 46, forming an intake to fans 46. This flow continues during normal operation of the diplay space to maintain the product at the preselected temperature range.

Periodically, frost accumulation on the surfaces within the coil unit, caused by entry of moisture into the display space with repeated opening of doors 24, necessitates defrosting of the coil surfaces. For this purpose, the apparatus employs a short circuiting flow system. More specifically, astraddle of coil 42 are a plurality of ambient defrost air inlet ports 54 in the front portion of the top of the cabinet, and a plurality of the defrost air discharge ports 56 in the rear portion of the top of the cabinet. Chamber 40 between entry ports 54 and discharge ports 56 is closed around coil 42 to prevent air by-passing it. Entry ports 54 are closed during normal refrigeration operation of the case, by doors 60 pivotally mounted along the rear edge thereof on brackets 62. These doors can be elevated from the lower closed position to raised opened condition, to open ports 54 to the ambient air above the top of the display cabinet. This opening operation is caused by a controlled actuator, e.g. an electrical motor 66 or the equivalent, through a pair of interconnected links 68 and 70 to a tie bar 72 interconnecting the doors. Operation of the motor pivots link 68 in an arc to elevate the doors. Discharge ports 56 are closed by doors 73 pivotally mounted at the forward edges thereof to be shiftable between a closed condition and an opened condition by actuators 74 through links 76 connected to tie bars 78. With doors 73 raised, discharge ports 56 are open to the ambient atmosphere above the rear of the display. The operation of these discharge doors is just like that explained and shown for the entry doors.

The number of entry and discharge ports and corresponding doors can vary. Normally, there is one coil section for each case segment containing access doors 24, with numerous entry ports and discharge ports per coil section.

During normal refrigeration operation, doors 60 and 73 are maintained in a closed position. Fans 46 are operated by motors 49 to cause constant recirculation of air through coil 42 where the air is cooled, and through restricted flue 50 or duct down the back side of the display space, into bottom horizontal flue 51, which is formed below product pans 52 and above bottom 20. The air then discharges vertically across doors 24 and product 31, through opening 48', the intake to fans 46. (See solid line arrows in FIG. 2) Moisture entering the display space is precipitated as undesirable frost on the cold surfaces of the coil. At selected intervals, the coil must be defrosted to allow effective air flow and heat exchange. This defrosting is achieved by maintaining fans 46 in operation, while opening doors 60 on defrost air entry ports 54 and doors 73 over defrost air discharge ports 56, to thereby create a short circuit air flow system. Specifically, warm ambient air is caused to enter ports 54 and be propelled by fans 46 through coil 42 to defrost it and discharge out through ports 56. (See dash line arrows) Only a minor insignificant portion of the air finds its way through the restricted duct passage 50 with its greater resistance to flow, thereby aerodynamically isolating the display space from the chamber, the coil, and the defrost air. Therefore the cold display space air is basically stagnant during defrost, to maintain its cold condition without melting of product or significant frost formation on product surfaces. After coil 42 is defrosted, e.g. after a predetermined short time interval or when the coil surfaces reach a predetermined temperature, doors 60 and 73 are closed, terminating defrost and re-establishing refrigerated air flow about the display space.

It is conceivable that those in the art, after studying this disclosure, may modify certain details of the arrangement to suit a particular type of situation or case construction. Hence the invention is intended to be limited only by the scope of the appended claims rather than to the preferred illustrated exemplary construction set forth in detail above.

The embodiments of the invention in which an exclusive property or privilege is claimed are defined as follows:

1. A reach-in refrigerated display case comprising:

a cabinet defining a product storage and display space therein and a coil chamber; access doors on one side of said cabinet to said storage and display space; refrigeration coil means in said chamber; recirculatory passage means between said space and said coil means including cold air flue means from said coil means to said space and return air flue means from said space back to said coil, at least one of said flue means being restricted to flow; air propelling means in said chamber for propelling air from said return flue means, to said coil means, then to said cold air flue means for passage about said product zone during normal operation; defrost inlet and outlet ports to and from said chamber and astraddle of said coil means and propelling means, the flow resistance through said ports being insignificant compared to that through said flues and display space, for flow of defrosting ambient air through said inlet ports, said coil means, and said outlet ports under the influence of said propelling means to cause a short circuit flow of ambient air through said coil without significant flow through said product space when said ports are open, thereby creating aerodynamic isolation of the coil means from the display during defrost; doors on said inlet and outlet ports to open and close said ports; and door opening and closing means for said doors.

2. The display case in claim 1 wherein said cold air flue means to said display space includes confined duct means having air distribution outlets, thereby forming the restricted flow.

3. The display case in claim 2 wherein said coil chamber is above said display space, and said inlet and discharge ports for ambient air are through the top of said cabinet.

4. A reach-in refrigerated display case achieving aerodynamic isolation of the coil from the product space during defrost, comprising:

a cabinet defining a product storage and display space and a coil chamber; partition means separating said product space and coil chamber; refrigeration coil means in said chamber; recirculatory flues from said coil chamber to said display space and back for cold air circulation during normal operation; air propelling means adjacent said coil means in said coil chamber; selectively openable and closeable defrost air inlet and discharge ports from the outside of said cabinet to said chamber, astraddle of said refrigeration coil means for flow of ambient air through said refrigeration coil means; the flow resistance through said inlet and discharge ports being insignificant compared to that through said recirculatory flues, creating aerodynamic isolation of said coil means and coil chamber from said display space while said ports are open during defrost.

5. A reach-in refrigerated display case comprising:

a cabinet defining a product storage and display space therein and a top coil chamber above said space; access doors on one side of said cabinet to said storage and display space; refrigeration coil means in said top chamber above said storage and display space; a partition between said chamber and said space; recirculatory passage means between said space and said coil means including cold air flue means from said coil means to said space and return air flue means from said space back to said coil, at least one of said flue means being restricted; air propelling means in said chamber for propelling air during normal operation from said return flue means, to said coil means, then to said cold air flue means for passage about said product zone; short circuit defrost inlet and outlet ports in the top of said cabinet to and from said chamber and astraddle of said coil means and propelling means for forming a short circuit flow during defrost, the flow resistance through said ports being only minor compared to that through said flues and display space, to cause defrosting ambient air to flow through said inlet ports, said coil means, and said outlet ports under the influence of said propelling means to short circuit air flow through said coil without significant concomitant flow through said product space when said ports are open; doors on said inlet and outlet ports to open and close said ports, and door opening and closing means for said doors.

* * * * *